US006619176B2

(12) United States Patent
Renfro et al.

(10) Patent No.: US 6,619,176 B2
(45) Date of Patent: Sep. 16, 2003

(54) THINNED-SKIRT SHAPED-CHARGE LINER

(75) Inventors: Steven L. Renfro, Burleson, TX (US); Don R. Pitts, Cleburne, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/083,449

(22) Filed: Feb. 25, 2002

(65) Prior Publication Data

US 2002/0078850 A1 Jun. 27, 2002

Related U.S. Application Data

(62) Division of application No. 09/635,298, filed on Aug. 9, 2000, now abandoned.

(51) Int. Cl.[7] ..... B21K 21/06

(52) U.S. Cl. ..... 86/51; 102/307; 102/476; 175/4.6; 86/1.1

(58) Field of Search ..... 102/306–310, 102/476; 175/4.6; 86/1.1, 51, 53

(56) References Cited

U.S. PATENT DOCUMENTS

| | | | | | |
|---|---|---|---|---|---|
| 2,629,325 | A | * | 2/1953 | Sweetman | 102/310 |
| 2,974,595 | A | * | 3/1961 | Mohaupt | 102/476 |
| 3,431,850 | A | * | 3/1969 | Christopher | 102/306 |
| 5,509,356 | A | * | 4/1996 | Renfro | 102/307 |
| 6,026,750 | A | * | 2/2000 | Nelson | 102/476 |
| 6,349,649 | B1 | * | 2/2002 | Jacoby et al. | 102/307 |

FOREIGN PATENT DOCUMENTS

| | | | | |
|---|---|---|---|---|
| GB | 2257 497 | * | 1/1993 | 102/307 |

* cited by examiner

*Primary Examiner*—Harold J. Tudor
(74) *Attorney, Agent, or Firm*—Michael W. Piper

(57) ABSTRACT

The embodiments of the present invention involve a thinned-skirt shaped-charge liner, a shaped-charge explosive incorporating the liner, and methods for making the liner. The focus of the most preferred embodiment of the present invention is the machining of the skirt portion of the liner to thin that portion to a thickness within about 25% of the thickness of the material around the center of the apex of the liner. The goal is to reduce debris and carrot size without sacrificing performance. In an alternative embodiment of the liner, at least some of the skirt portion of the liner is machined to a rough machine finish, but the mass of the material removed in the machining is insignificant to negligible. The liner of the present invention may be incorporated into a shaped-charge which includes a housing, a shaped-explosive, and the liner, preferably having an opening at the center of the apex of the liner. The preferred embodiment of the shaped-charge would also include a coating at the opening; where the coating contacts both the shaped-explosive and the open space between the liner and the mouth of the housing. The preferred method of making the liner would involve drawing a material into the liner shape, removing any excess material, and machining at least some of the skirt portion of the liner, removing material and thereby reducing the thickness of the skirt portion. One alternative method for making the liner would use a spinning process rather than a drawing process.

11 Claims, 3 Drawing Sheets

THINNED-SKIRT SHAPED-CHARGE LINER

This is a divisional application of U.S. patent application Ser. No. 09/635,298, filed Aug. 09, 2000, now abandoned hereby incorporated by reference in its entirety.

FIELD OF THE INVENTION

The present invention is concerned with explosive shaped-charges, and more particularly to an improved liner for use in such shaped-charges, an improved shape charge which is especially useful in a well pipe perforating gun, and a method for making them.

BACKGROUND OF THE INVENTION

The use of shaped-charges for perforating the tubing, pipes, or casings used to line wells such as oil and natural gas wells and the like, is well-known in the art. For example, U.S. Pat. No. 3,128,701, issued Apr. 14, 1964 to J. S. Rinehart et al, discloses a shaped-charge perforating apparatus for perforating oil well casings and well bore holes.

The art has also devoted attention to providing a particular configuration of the shaped-charge and its liner as shown, for example, in U.S. Pat. No. 5,221,808, issued Jun. 22, 1993 to A. T. Werner et al. The shaped-charge therein disclosed includes the usual case, concave shaped explosive material packed against the inner wall of the case, and a metal liner lining the concave side of the shaped explosive. As disclosed in the paragraph bridging columns 3 and 4 of the patent, the taper is said to exist in the thickness of the liner 14 starting at the apex 18 thereof and ending with the skirt 16 thereof. At the first ten lines of column 4, specifications are given for the copper-bismuth liner 14 including a maximum variation in thickness along any given transverse section of the liner, a specified thickness of the skirt 16 of the liner 14, and the taper of the liner at the apex 18 and the skirt 16. U.S. Pat. No. 5,509,356 issued Apr. 23, 1996 to Steven L. Renfro, the disclosure of which is incorporated herein by reference, also addresses control of liner thickness. The disclosure of this patent proposes a spinning manufacturing process to produce a liner having a closed end apex 5% to 50% thicker, preferably 25% thicker, than its skirt.

Generally, shaped-charges utilized as well perforating charges include a generally cylindrical or cup-shaped housing having an open end and within which is mounted a shaped explosive which is configured generally as a hollow cone having its concave side facing the open end of the housing. The concave surface of the explosive is lined with a thin metal liner which, as is well-known in the art, is explosively driven to hydrodynamically form a jet of material with fluid-like properties upon detonation of the explosive and this jet of viscous material exhibits a good penetrating power to pierce the well pipe, its concrete liner and the surrounding earth formation. Typically, the shaped-charges are configured so that the liners along the concave surfaces thereof define simple conical liners with a small radius apex at a radius angle of from about 55 degrees to about 60 degrees. Other charges have a hemispherical apex fitted with a liner of uniform thickness.

Generally, explosive materials such as HMX, RDX, PYX, or HNS are coated or blended with binders such as wax or synthetic polymeric reactive binders such as that sold under the trademark KEL-F. The resultant mixture is cold- or hot-pressed to approximately 90% of its theoretical maximum density directly into the shaped-charge case. The resulting shaped-charges are initiated by means of a booster or priming charge positioned at or near the apex of the shaped-charge and located so that a detonating fuse, detonating cord or electrical detonator may be positioned in close proximity to the priming charge.

The known prior art shaped-charges are typically designed as either deep-penetrating charges or large-diameter hole charges. Generally, shaped-charges designed for use in perforating guns contain 5 to 60 grams of high explosive and those designed as deep-penetrating charges will typically penetrate concrete from 10 inches to over 50 inches. Large-diameter hole shaped-charges for perforating guns create holes on the order of about one inch in diameter and display concrete penetration of up to about 9 inches. Such data have been established using API RP43, Section I test methods.

SUMMARY OF THE INVENTION

The embodiments of the present invention involve a shaped-charge liner, a shaped-charge explosive incorporating the liner, and methods for making the liner. The liner of the present invention includes a convex outer surface, a concave inner surface, an apex having a center, and a mouth portion of the liner opposite the apex of the liner. The liner also incorporates a skirt portion terminating in a circular skirt edge at the mouth portion of the liner. In the preferred embodiment of the liner, at least some of the skirt portion of the liner has had material removed by machining reducing the thickness of the skirt portion and as a result, the machined skirt portion has a thickness within about 25% of the thickness of the material around the center of the apex. Additionally, the liner may incorporate a circular opening at the center of the apex where the ratio of the diameter of the opening to the diameter of the circular skirt edge is between about 0.05 and about 0.35.

In an alternative embodiment of the liner, at least some of the skirt portion of the liner has been machined to a rough machine finish, but without necessarily removing significant amounts of material. In this alternative embodiment, the mass of the material removed in the machining is less than 5% of the mass of the liner, more preferably less than 1% of the mass of the liner, and most preferably less than 0.1% of the mass of the liner.

The liner of the present invention may be incorporated into a shaped-charge. Such a shaped-charge would include a housing having an inner wall, an outer wall, a base, and a mouth portion opposite the base, a shaped-explosive having an open concave side and mounted on the inner wall of the housing with the concave side of the shaped explosive facing the mouth portion of the housing, and the liner, preferably having an opening at the center of the apex. The liner would line the concave side of the shaped explosive, leaving an open space between the liner and the mouth portion of the housing. The preferred embodiment of the shaped-charge would also include a coating at the opening at the center of the apex of the liner; where the coating contacts the shaped-explosive and the open space between the liner and the mouth portion of the housing. This coating could be single or multiple layers, but would preferably include an adhesive.

The liner of the present invention could be made by more than one method. The preferred method would involve drawing a flat material into a concave shape radially symmetric about a central axis having an apex centered on the central axis and a mouth at the opposite end from the apex. In this act, the center of the material is drawn down to form the apex while the perimeter of the material forms a skirt portion terminating in a circular skirt edge at the mouth of the liner. The method would also call for removing any excess flat material outside the circular skirt edge forming the mouth. Finally, the method would also include machining at least some of the skirt portion removing material and thereby reducing the thickness of the skirt portion.

One alternative method for making the liner would use a spinning process rather than a drawing process. This method would include spinning a sheet of material into a concave shape radially symmetric about a central axis having an apex centered on the central axis and a mouth at the opposite end from the apex, wherein a portion of the material forms the apex and a portion of the material forms a skirt portion terminating in a circular skirt edge at the mouth of the liner. The method would again involve removing any excess material outside the circular skirt edge forming the mouth and machining at least some of the skirt portion removing material and thereby reducing the thickness of the skirt portion. This method could also include machining the apex of the liner removing material and thereby reducing the thickness of the apex until the thickness of the apex is within about 25% of the thickness of the skirt portion.

DESCRIPTION OF THE DRAWINGS

The invention, together with further advantages thereof, may best be understood by reference to the following description taken in conjunction with the accompanying drawings in which.

DETAILED DESCRIPTION

Figure 1:
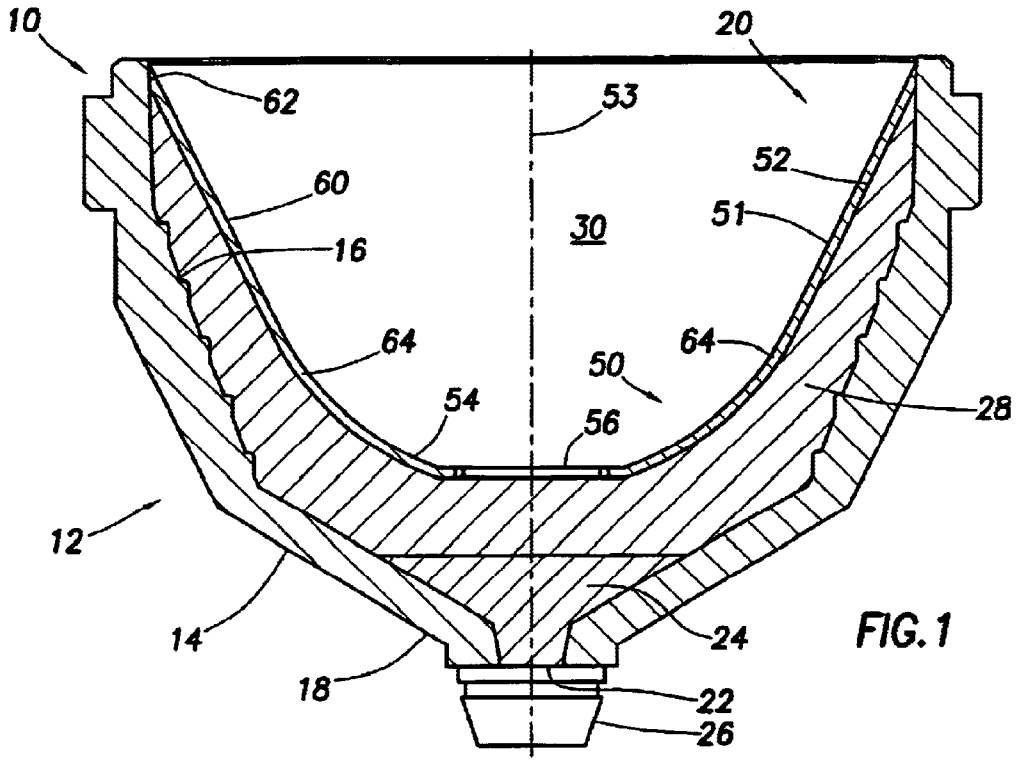
FIG. 1 is a cross-sectional diagram illustrating an assembled shaped-charge including a liner having a hemispherical apex.

The shaped-charge liners of the preferred embodiment of the present invention are manufactured using a draw process followed by a selective machining of the skirt area to remove material. Conventional drawn or stamped liners stretch solid material, typically from a sheet or strip, to form the liner shape. This creates a liner that is thinner at the apex than at the skirt. The majority of work performed by an explosively formed projectile is performed by the material at the apex. In order to increase the work, and therefore the entrance hole and penetration, it is necessary in the process to increase the thickness of the stock material. This tends to decrease efficiency and increase the amount of debris left over. By using the techniques described herein, it is possible to selectively increase the working mass, the liner at the apex, without increasing the debris. By reducing the material in the skirt, the debris may be reduced without significantly impacting the performance. Although not the most preferred embodiment, the extreme case is to reverse the normal taper, by reducing the skirt to a thickness less than the thickness of the apex, which brings more material into the jet and decreases the amount of material available for debris.

The present invention incorporates the use of machining in the skirt area to help reduce debris. This may in part occur due to mechanical effects in the liner material itself from the machining process, which leaves a series of striations in the physical exterior of the skirt portion of the liner. This may encourage break up of the liner into smaller components during explosion reducing both the size of the carrot or slug and the total amount of debris, as the smaller components are more easily consumed by the explosion itself. The selective shaping also removes material in the skirt of the liner normally left over in the form of a slug or carrot. By reducing the mass in the skirt area, the velocity of the liner in the skirt area is increased, which increases the efficiency of the liner mass. While in the preferred embodiment, the machining is performed on the skirt portion on the convex side of the liner for ease of manufacturing; most of the benefits of skirt-thinning could equally be obtained by machining the concave side of the liner or both sides of the liner.

A preferred embodiment of the present invention also incorporates the use of an opening, preferably circular, at the center of the apex of the liner. The opening at the apex is especially usefull in "big hole" applications, as it enhances entrance hole performance, although there typically is a trade off in terms of loss of penetration. When assembled in a shape-charge, the liner opening is not covered or blocked by a metal disk or other solid structure. The liner is placed directly on the explosive charge and in the area of the opening, the only thing between the charge and the open space on the other side of the liner is a coating applied to discourage salting out of the explosive. The coating is most preferably an adhesive/paint sold under the trademark Glyptol, preferably an adhesive selected from an epoxy material compatible with the explosive material, and generally comprises an adhesive. The coating may be a single layer either of adhesive alone or adhesive in combination with graphite. The coating may also be more than one layer, with a layer as described above and additional layers contributing to other properties, such as improving the moisture barrier characteristics, or improving the slight amount of time the coating acts as to dynamically confine the explosive gases which are the product of detonation. For example the coating may have at least two distinct layers with one layer comprising an adhesive and the second layer comprising a thin metallic film. Similarly, the coating may take the form of a thin cover or sticker, typically multi-layer with a lower layer including an adhesive, where the cover or sticker is applied in a manner to effectively coat the opening with the adhesive. The coating as a whole is preferably no more than twice the thickness of the liner around the opening in the apex, and more preferably about the thickness of the liner around the opening of the apex. This tends to place the thickness of the coating within the range of about 0.002 inches to about 0.05 inches.

The liner of the present invention may be made by any of several methods involving the machining of material from the skirt. The liner itself is preferably made from a metal strip or sheet, more preferably from a metal selected from the group of copper, copper alloy, aluminum, aluminum alloy, tin, tin alloy, lead, and lead alloy, and most preferably made of copper. In alternative processes, the liner may be made from a powdered metal within a polymeric base which is molded into the form of a liner or from a sintered metal, possibly with other components which is cast or molded into a desired shape. Although these alternative processes would typically be manufactured using a molding or casting process, post molding or casting efforts to machine or mechanically remove material from the skirt portions would still bring them within the benefits of the present invention.

The preferred method for making the liner calls for drawing the chosen material, (preferably from a flat state) into a concave shape radially symmetric about a central axis passing through and perpendicular to the center of the apex, where radial symmetry about an axis is intended to describe concentricity about such axis within any plane defined perpendicular to such axis and intersecting such axis. In this process the center of the material is drawn down to form the apex while the perimeter of the material form a skirt portion terminating in a circular skirt edge at the mouth of the liner. Depending on the desired apex shape and other factors, the draw may be done in a single step or may be done in several steps. For a hemispherical apex, a single step draw is preferable. The drawing process may result in creation of a slight necking point in the material, where the thickness is slightly reduced generally in the area near the transition from the skirt portion to the apex portion of the liner. Multiple step draws tend to leave several necking points near each radial transition, but these are generally smaller and less well defined. Multiple step draws are preferable when the desired apex profile is parabolic such as the more complex flattened parabolic apex described in this disclosure.

If the embodiment being built incorporates an opening in the apex, then a punch is used to punch the opening in the apex centered on the central axis. This preferably occurs in the same sequence as the drawing process to increase reliability of the central axis for the punch being identical to the central axis for the draw. Other alternatives to the use of a punch to create the hole include drilling, honing, sawing, or chemically etching.

The draw is preferably done from a sheet of material, but may also be performed on pre-cut and sized discs or other shaped blanks. At the conclusion of the draw, either preferably as a final step in the drawing process using the drawing tools, or as a separate step, any excess flat material from the sheet or blank outside of the circular skirt edge forming the mouth of the liner must be removed. Additionally, in some embodiments, following removal of any excess flat material, an additional step may be undertaken to trim the height of the liner to a desired size.

Once a liner is obtained through drawing, under the present invention at least some of the skirt portion of the material is machined, removing material and thereby reducing the thickness of the skirt portion. Machining in the context of this disclosure is intended to include any form of mechanical removal of material, be it by cutting, lathing, grinding, threading, scoring, and the like. While most preferably the thickness of the skirt is reduced significantly, benefits may also be gained from only a slight removal of material and consequently slight reduction in thickness, as this may still provide improved break-up properties in the skirt portion of the liner, resulting in reduced debris. This preferred method machines the skirt portion to reduce the thickness of the skirt portion until the skirt portion has a thickness within about 25% (i.e. between 25% more thick and 25% less thick) of the thickness of the material around the center of the apex and more preferably to within about a 5% difference from the thickness of the material around the center of the apex. The most preferable machining for the drawing method machines the thickness of the skirt portion until the thickness of the skirt portion is between about equal to and about 25% greater than the thickness of the apex. The thickness for the skirt portion is evaluated at the thickest point within the machined portion. The thickness of the apex is evaluated around the center of the apex.

The machining preferably starts at or about the circular skirt edge and moves down the side of the liner through at least a portion of the skirt portion of the liner. The preferred depth of machining is the machining to attain the desired thickness, most preferably seeking to make a more uniform thickness. The preferred starting point is about the circular skirt edge. The most desirable point to stop machining on a given liner design may be based on several competing considerations. In evaluating where and how much to machine, the first step is to determine the machining point that provides the optimal debris size reduction. The second step typically is to make evaluations based on performance of the resulting charge, both entrance hole diameter performance and penetration. These factors are balanced in consideration of the specific primary function and typical projected use of the liner being designed. Two methods which are at times complementary are used to help evaluate the preferred machining point, where one of the methods evaluates based on optimal mass reduction to reduce carrot size and debris, and the other method is concerned with preserving or encouraging liner continuity resulting from a drawing process.

The desired mass reduction of the liner is determined experimentally for an existing design. As each test shot is fired and measurements of the results made, the total mass recovered is divided by the original mass of the liner to determine a percentage. In an effort to generate an approximate amount of mass desired to be removed, this mass recovered percentage is divided by the mass of the recovered carrots, which seems to provide a good reference point. Assuming that the carrot is formed from material originating in the skirt area, the mass required for modification is calculated from the large open end toward the apex. Thus, the preferred machining point would be the point where the mass removed by machining is equal to average mass recovered percentage divided by the average mass of the recovered carrots. Given the preferred depth of machining to reach the desired thickness, the preferred machining point is typically between about 40% to about 60% of the total height of the liner depending on the geometry.

A second method is used based on the flow of material in the draw process. Typically, a draw process will produce one or more necked down sections that are thinner than the surrounding material. This point is a disruption to the continuity of the liner, especially after modifications are made. By staying above this point, or alternatively machining it uniform, the disruptive effects of this thinning can be minimized. Hence, particularly with liners formed through a single-step draw which tend to have a more defined necking point, an alternative machining goes from about the skirt edge to about the point of necking, but most preferably not past the point of necking. For example the skirt portion may be machined to within about 0.2 inches of the necking point on either side and more preferably between about the necking point and about 0.1 inches before the necking point.

Alternatively, the machining could start at some point below the circular skirt edge, or could start from the lower in the skirt portion or near the border between the apex portion and the skirt portion and travel towards the circular skirt edge. But these, while still contributing towards reduced debris, are somewhat less desirable from a manufacturing standpoint or possibly from an entrance hole size standpoint.

In an alternative method of manufacture, the liners of the present invention may be manufactured by spinning a sheet of material into a concave shape radially symmetric about a central axis, having an apex centered on the central axis and a mouth at the opposite end from the apex, wherein a portion of the material forms the apex and a portion of the material forms a skirt portion terminating in a circular skirt edge at the mouth of the liner. Following the spinning process there must be a removal of any excess material outside the circular skirt edge forming the mouth. If an opening in the apex is desired, this may be accomplished by the use of a punch or drill, after the completion of the spinning process.

The spun liner will tend to start with an apex thickness greater than the skirt thickness. In the present invention there will still be machining of at least some of the skirt portion removing material and thereby reducing the thickness of the skirt portion. Since the skirt material is already thinner, the material removed will be less than for a drawn liner and may be the slight amount suggested above to gain mechanical advantage from the machining striations, without need to create significant reduction in thickness. With a spun liner there may also be machining of the apex of the liner removing material and thereby reducing the thickness of the apex until the thickness of the apex is within about 25% of the thickness of the skirt portion (i.e. between 25% more thick and 25% less thick) and more preferably to within about a 5% difference from the thickness of the material of the skirt portion. For this alternative method, an alternative machining process would machine the thickness of the apex until the thickness of the skirt portion is between about equal to and about 25% greater than the thickness of the apex.

FIG. 1 is a cross-sectional diagram illustrating one specific embodiment of the present invention. FIG. 1 is a cross-section of a shaped-charge 10 having a liner 50 with a hemispherical apex 54. The shaped-charge 10 includes a housing 12 having an outer wall 14, an inner wall 16, a base 18, and a mouth 20 opposite the base 18. Within the housing is contained a shaped explosive 28 mounted on the inner wall 16 of the housing 12 and having an open concave side facing the mouth 20 (or mouth portion) of the housing.

The housing 12 also contains a chamber 22 to hold an initiation charge 24. The initiation charge 24 preferably is actually larger than chamber 22 and flows into the area housing the main shaped explosive 28. The initiation charge 24 is triggered by an explosive member, preferably a linear explosive member linking and initiating several shaped-charges, contained at least in part within primer container 26 attached to the base 18 of housing 12.

The shaped-charge liner 50 has a concave inner surface 51, a convex outer surface 52, an apex 54 (or apex portion), and a mouth opposite the apex 54 (illustrated here contiguous to mouth 20 of housing 12). The apex 54 has a center at a point where the apex 54 intersects the central axis 53 about which the shaped-charge liner is radially symmetric. The embodiment illustrated in FIG. 1 further includes an opening 56 at the center of the apex 54. The liner 50 also includes a skirt portion 60 terminating in a circular skirt edge 62 at the mouth of the liner on the opposite end of the liner from the apex 54. The liner 50 lines the concave side of the shaped explosive 28 leaving an open space 30 between the concave inner surface 51 of the liner and the mouth 20 of the housing.

Except at the opening 56, the shaped explosive 28 is bounded by the housing inner wall 16, the initiation charge 24, and the convex outer surface 52 of the liner 50. At the opening 56 of the liner 50, the explosive charge would be in direct contact only with the open space 30 in the housing. The only material blocking this direct contact is a coating (not pictured) having a thickness preferably no more than twice the thickness of the liner 50 around the opening 56 and preferably having about the same thickness as the liner 50 around the opening 56. The coating is preferably applied over the center opening 56 after the liner 50 has been inserted to the housing 12 and compressed against the shaped explosive 28. The coating preferably at least covers the entire opening 56 and more preferably has some overlap onto surface around the center of the apex 54. The coating contacts the shaped-explosive 28 and the open space 30 between the liner 50 and the mouth 20 of the housing 12.

The embodiment illustrated in FIG. 1 is drawn in a single step and has a necking point 64 near the transition between the skirt portion 60 and the apex portion 54 of the liner 50. The transition between the skirt portion 60 and the apex portion 54 of the liner 50 is roughly defined as the transition from a straighter, although not necessarily completely straight, skirt section 60 from the skirt edge 62 of the liner 50 to the more curved (having a shorter radius of curvature) apex portion 54 of the liner 50. In the hemispherical apex liner illustrated here, this is a single transition point more easily defined. With a more complex curve, the transition is a transition region of gradually decreasing radius of curvature, which may decrease stepwise or ideally in a curvilinear fashion. The necking point 64 identified in the drawing of FIG. 1 is illustrative, but is not intended to be correct to scale. The most preferred machining of the skirt portion 60 would result in machining from the circular skirt edge 62 to about the necking point 64 but most preferably not past the necking point 64.

Figure 2:
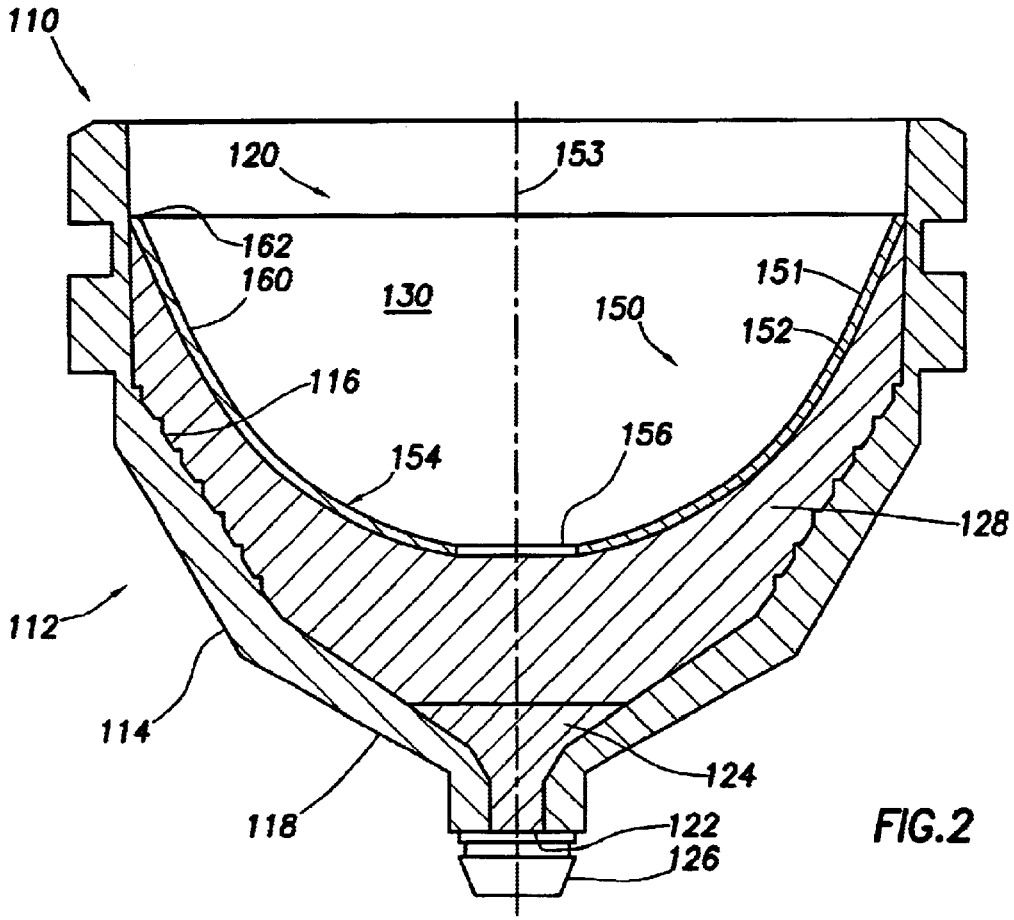
FIG. 2 is a cross-sectional diagram illustrating an assembled shaped-charge including a liner having a flattened parabolic apex.

FIG. 2 is a cross-sectional diagram illustrating a distinct specific embodiment of the present invention. FIG. 2 is a cross-section of a shaped-charge 110 having a liner 150 with a flattened parabolic apex 154. The shaped-charge 110 includes a housing 112 having an outer wall 114, an inner wall 116, a base 118, and a mouth 120 opposite the base 118 Within the housing is contained a shaped explosive 128 mounted on the inner wall 116 of the housing 112 and having an open concave side facing the mouth 120 (or mouth portion) of the housing. The mouth 120 is typically covered after assembly by a cover 132.

The housing 112 also contains a chamber 122 to hold an initiation charge 124. The initiation charge 124 is triggered by an explosive member contained at least in part within primer container 126 attached to the base 118 of housing 112.

The shaped-charge liner 150 has a concave inner surface 151, a convex outer surface 152, an apex 154 (or apex portion), and a mouth opposite the apex 154 (illustrated here contiguous to mouth 120 of housing 112). The apex 154 has a center at a point where the apex 154 intersects the central axis 153 about which the shaped-charge liner is radially symmetric. The embodiment illustrated in FIG. 2 further includes an opening 156 at the center of the apex 154. The liner 150 also includes a skirt portion 160 terminating in a circular skirt edge 162 at the mouth of the liner on the opposite end of the liner from the apex 154. The liner 150 lines the concave side of the shaped explosive 128 leaving an open space 130 between the concave inner surface 151 of the liner and the mouth 120 of the housing.

Except at the opening 156, the shaped explosive 128 is bounded by the housing inner wall 116, the initiation charge 124, and the convex outer surface 152 of the liner 150. At the opening 156 of the liner 150, the explosive charge would be in direct contact only with the open space 130 in the housing. The only material blocking this direct contact is a coating such as described with respect to the embodiment of FIG. 1. The coating contacts the shaped-explosive 128 and the open space 130 between the liner 150 and the mouth 120 of the housing 112.

The embodiment illustrated in FIG. 2 is drawn multiple steps. The transition between the skirt portion 160 and the apex portion 154 of the liner 150 is roughly defined as the transition from a straighter, although not necessarily completely straight, skirt section 160 from the skirt edge 162 of the liner 150 to the more curved (having a shorter radius of curvature) apex portion 154 of the liner 150. With the more complex curve of this embodiment, the transition is a transition region of gradually decreasing radius of curvature, which may decrease stepwise or in an approximately curvilinear fashion. The preferred machining of the skirt portion 160 would result in machining from the circular skirt edge 162 to about 40% of the height of the liner measured down from the skirt edge but most preferably not past about 80% of the height of the liner measured down from the skirt edge.

Figure 3:
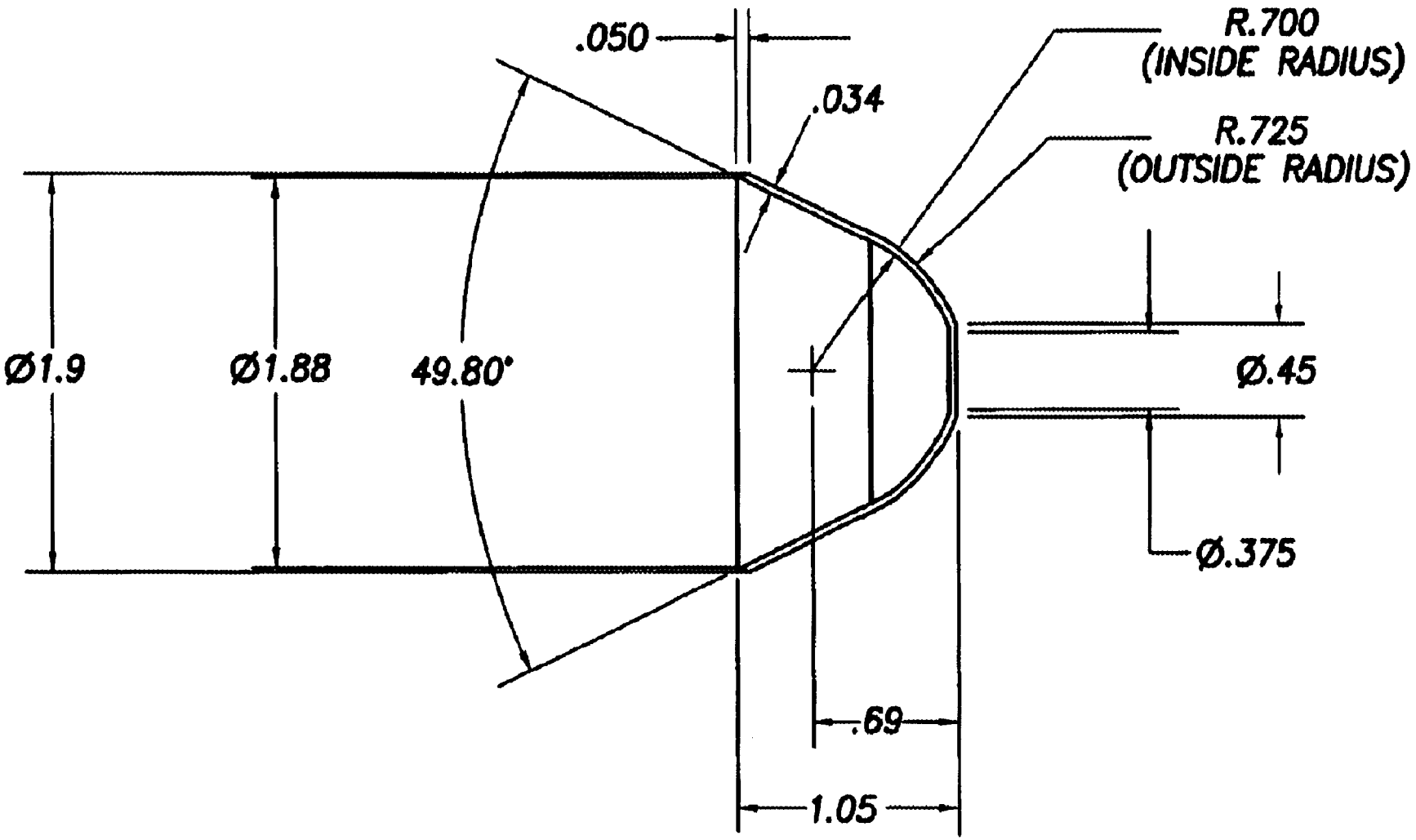
FIG. 3 is a cross-sectional diagram illustrating a hemicone liner having a hemispherical apex.

The hemi-cone liner, illustrated in FIG. 3, consists of a hemispherical or partially hemispherical section located at the apex of the liner. The hemispherical apex is blended in a curvilinear fashion to a simple truncated conical section that extends to the opening of the case. This type of liner allows an increased standoff for the hemispherical section while minimizing the amount of explosive material necessary to fill the case. The conical section allows this standoff while maintaining a solid boundary between the explosive and the cavity within the shaped-charge.

In the described example of FIG. 3, the opening at the center of the apex has a diameter of about 0.375 inches and the circular skirt edge has a diameter of about 1.9 inches. In this example the ratio of the diameter of the opening to the diameter of the circular skirt edge is about 0.2. Preferably the ratio of the diameter of the opening to the diameter of the circular skirt edge is between about 0.05 and about 0.35 and more preferably the ratio of the diameter of the opening to the diameter of the circular skirt edge is between about 0.10 and about 0.25. In the specific examples disclosed herein the opening at the center of the apex preferably has a diameter of between about 0.30 inches and about 0.45 inches.

Figure 4:
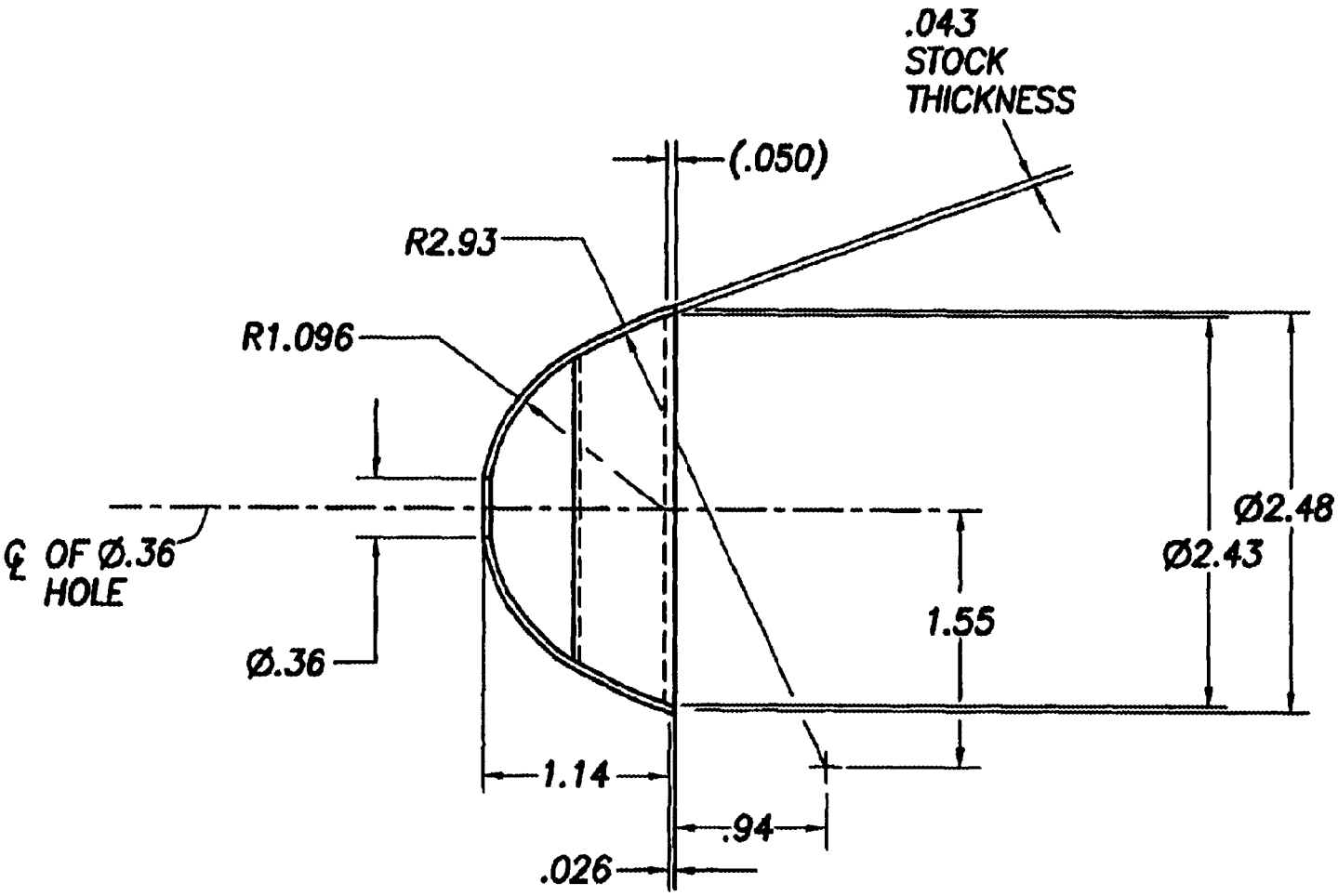
FIG. 4 is a cross-sectional diagram illustrating a flat-bottom cone liner having a flattened parabolic apex.

In the described example of FIG. 4, the opening at the center of the apex has a diameter of about 0.36 inches and the circular skirt edge has a diameter of about 2.45 inches. In this example the ratio of the diameter of the opening to the diameter of the circular skirt edge is about 0.15.

The flat bottom cone liner illustrated in FIG. 4, is related to the hemi-cone, however, instead of a simple truncated cone section the extended portion consists of a slightly radiused transition to the opening of the case. This is also referred to as a flattened parabolic shape apex, where the apex comprises a flattened parabola that is radially symmetric about the central axis passing through the center of the apex. This type of liner allows a larger apex and tends to distribute more explosive material directly behind the apex section. The flat bottom cone tends to be setback into the case relative to a hemi-cone.

While the embodiments particularly addressed above reflect the use of an approximately hemispherical apex liner and of a flattened parabolic apex liner, one of skill in the art will recognize that the benefits of the proposed invention could also apply in other shapes of liners, for example simple conical liners, slightly modified conical liners which take the form of ellipsoids (partial 3-dimensional ellipses), liners with hyperbolic apexes, liners with truncated apexes, other shapes familiar to those of skill in the art. In any event, the liners are preferably radially symmetric about the central axis passing through the center of the apex. While the disclosure herein refers to concave and convex surfaces to describe the general orientation of the surface within the context of the object, the use of convex and concave are not intended to imply a requirement that the surface be smooth or curvilinear.

While the transition from the skirt portion of the liners to the apex portion of the liners is less clear in some of the alternate liner shapes proposed, a rough guide for the transition in the absence of other factors is that the first ⅔ of the height of the liner from the skirt edge down towards the apex may be considered the skirt portion and the last ⅓ of the height may be considered the apex portion. Machining in these circumstances, where the transition is not capable of clear definition, would preferably be done from approximately the skirt edge through at least about ½ of the skirt portion (33% of the total height from the skirt edge down) and preferably not past about ½ of the liner portion (83⅓% of the total height from the skirt edge down) and more preferably not past the end of the skirt portion of the liner (66% of the total height from the skirt edge down). The desired thickness ratios would be similar to the described embodiments.

While the embodiments addressed above each have an opening in the apex, some benefit may still be gained from skirt-thinning even in the absence of such an opening. The thickness considered for thickness ratios would be the thickness at the center of the apex rather than the thickness of the apex around the opening and hence around the center of the apex. Liners of this type may demonstrate improved penetration characteristics, but would potentially also demonstrate reduced entrance hole diameter.

The embodiments addressed above involve an open shaped-charge, i.e. one without a cover. This type of shaped-charge is typically used within a perforating gun or tubing, which provides protection from direct exposure to the downhole pressure and environment. Alternative shaped-charges have covers that cooperate with the housing to protect each individual charge from direct exposure to the downhole environment. While not specifically addressed here, the benefits of the present invention would equally apply to such covered charges, as would be recognized by one of skill in the art.

A final alternative embodiment takes advantage of the benefits ascribed to the machining process on the skirt when even a slight amount of material is removed, which were discussed above. In this last alternative, at least some of the skirt portion is machined without removing material or without removing significant amounts of material, effectively threading or scoring the machined part of the skirt portion of the liner. Preferably, the mass of the removed material would be less than 5% of the mass of the liner, more preferably less than 1% of the mass of the liner, and most preferably less than 0.1% of the mass of the liner. In this embodiment, the benefits gained are most likely due to mechanical effects in the liner material itself from the machining process, which leaves a series of striations in the physical exterior of the skirt portion of the liner. This may encourage break up of the liner into smaller components during explosion reducing both the size of the carrot or slug and the total amount of debris, as the smaller components are more easily consumed by the explosion itself. The portion of the skirt portion to be machined would be similar to the portions discussed above for machining for removal of material from the skirt. The final surface finish would preferably create a rough machined surface finish, for example about a no. 125 finish, about a no. 64 finish, or somewhere in approximately that range.

Although only a few embodiments of the present invention have been described, it should be understood that the present invention may be embodied in many other specific forms without departing from the spirit or the scope of the present invention. Therefore, the present examples are to be considered as illustrative and not restrictive, and the invention is not to be limited to the details given herein, but may be modified within the scope of the appended claims along with their full scope of equivalents.

What is claimed is:

1. A method for making a liner for a shaped-charge, the method comprising:

drawing a flat material into a concave shape radially symmetric about a central axis having an apex centered on the central axis and a mouth at the opposite end from the apex, where the center of the material is drawn down to form the apex while the perimeter of the material forms a skirt portion terminating in a circular skirt edge at the mouth of the liner wherein the material the the apex has a thickness;

removing any excess flat material outside the circular skirt edge forming the mouth;

machining at least some of the skirt portion removing material and thereby reducing the thickness of the skirt portion wherein the machining of the skirt portion reduces the thickness of the skirt portion until the machined skirt portion has a thickness within about 25% of the thickness of the material forming the apex.

2. The method of claim 1 wherein the drawing and removing are each a part of the same manufacturing process.

3. The method of claim 1 wherein the drawing occurs in a single stage.

4. The method of claim 1 wherein the drawing occurs in at least two stages.

5. The method of claim 1 wherein the material comprises a metal.

6. The method of claim 5 wherein the material is selected from the group of copper, copper alloy, aluminium, aluminum alloy, tin, tin alloy, lead, and lead alloy.

7. The method of claim 6 wherein the material comprises copper.

8. The method of claim 1 wherein the liner has a total height from the circular skirt edge to the center of the apex, and wherein the skirt portion is machined from the circular skirt edge to between about 33% of the total height of the liner from the skirt edge down and about 83⅓% of the total height of the liner from the skirt edge down.

9. The method of claim 8 wherein the skirt portion is machined from the circular skirt edge to between about 33% of the total height of the liner from the skirt edge down and about 66% of the total height of the liner from the skirt edge down.

10. The method of claim 9 wherein the skirt portion is machined from the circular skirt edge to between about 40% of the total height of the liner from the skirt edge down and about 60% of the total height of the liner from the skirt edge down.

11. The method of claim 1, wherein:

the drawing of the apex produces a slight necking in the material; and wherein the skirt edge portion is machined from the circular skirt edge to about the point of the necking.

* * * * *